US008961104B2

(12) United States Patent
Kogame

(10) Patent No.: US 8,961,104 B2
(45) Date of Patent: Feb. 24, 2015

(54) VACUUM PUMP

(75) Inventor: Masahito Kogame, Kyoto (JP)

(73) Assignee: Shimadzu Corporation, Kyoto-shi (JP)

( * ) Notice: Subject to any disclaimer, the term of this patent is extended or adjusted under 35 U.S.C. 154(b) by 535 days.

(21) Appl. No.: 13/504,014

(22) PCT Filed: Nov. 2, 2009

(86) PCT No.: PCT/JP2009/068751
§ 371 (c)(1),
(2), (4) Date: Apr. 25, 2012

(87) PCT Pub. No.: WO2011/052087
PCT Pub. Date: May 5, 2011

(65) Prior Publication Data

US 2012/0219400 A1 Aug. 30, 2012

(51) Int. Cl.
*F04D 19/04* (2006.01)
*F04D 29/52* (2006.01)
*F04D 27/02* (2006.01)

(52) U.S. Cl.
CPC ..... *F04D 19/04* (2013.01); *F04D 19/042* (2013.01); *F04D 29/522* (2013.01); *F04D 27/0292* (2013.01)
USPC ..... 415/9; 415/90; 415/220

(58) Field of Classification Search
CPC F04D 19/042; F01D 21/045; F05D 2260/311
USPC ..... 415/9, 90, 213.1, 214.1, 220
See application file for complete search history.

(56) References Cited

U.S. PATENT DOCUMENTS

| | | | | |
|---|---|---|---|---|
| 6,854,956 | B2 * | 2/2005 | Miwata et al. | 415/90 |
| 7,059,823 | B2 * | 6/2006 | Sakaguchi et al. | 415/9 |
| 7,431,423 | B2 * | 10/2008 | Otsuki | 347/37 |
| 2001/0016160 | A1 | 8/2001 | Ikegami et al. | |
| 2002/0028132 | A1 | 3/2002 | Ikegami et al. | |
| 2003/0017047 | A1 | 1/2003 | Shiokawa et al. | |
| 2009/0211653 | A1 * | 8/2009 | Schofield | 137/565.23 |

FOREIGN PATENT DOCUMENTS

| | | | |
|---|---|---|---|
| JP | 6-4392 | U | 1/1994 |
| JP | 2006-170217 | A | 6/2006 |
| JP | 2008-002302 | A | 1/2008 |
| JP | 2008-262738 | A | 10/2008 |

OTHER PUBLICATIONS

International Search Report, PCT/JP2009/068751, Jan. 26, 2010.

* cited by examiner

*Primary Examiner* — Ninh H Nguyen
(74) *Attorney, Agent, or Firm* — Westerman, Hattori, Daniels & Adrian, LLP

(57) ABSTRACT

A turbomolecular pump includes a drag pump unit constituted with a rotational cylinder portion disposed at a rotor and a fixed cylinder (24) disposed via a gap on an outer circumferential side of the rotational cylinder portion. The fixed cylinder (24) includes: a cylinder upper portion (240*a*) locked to a base (1); and a cylinder lower portion (240*b*) connected to a discharge downstream side of the cylinder upper portion (240*a*) via a groove (243) formed so that a break occurs when the rotational cylinder portion (32) breaks and a broken rotational cylinder portion (32) collides with the fixed cylinder (24) subjecting the fixed cylinder (24) to a rotational torque working in a direction matching the direction in which the rotational cylinder portion (32) rotates.

5 Claims, 5 Drawing Sheets

VACUUM PUMP

TECHNICAL FIELD

Figure 1:
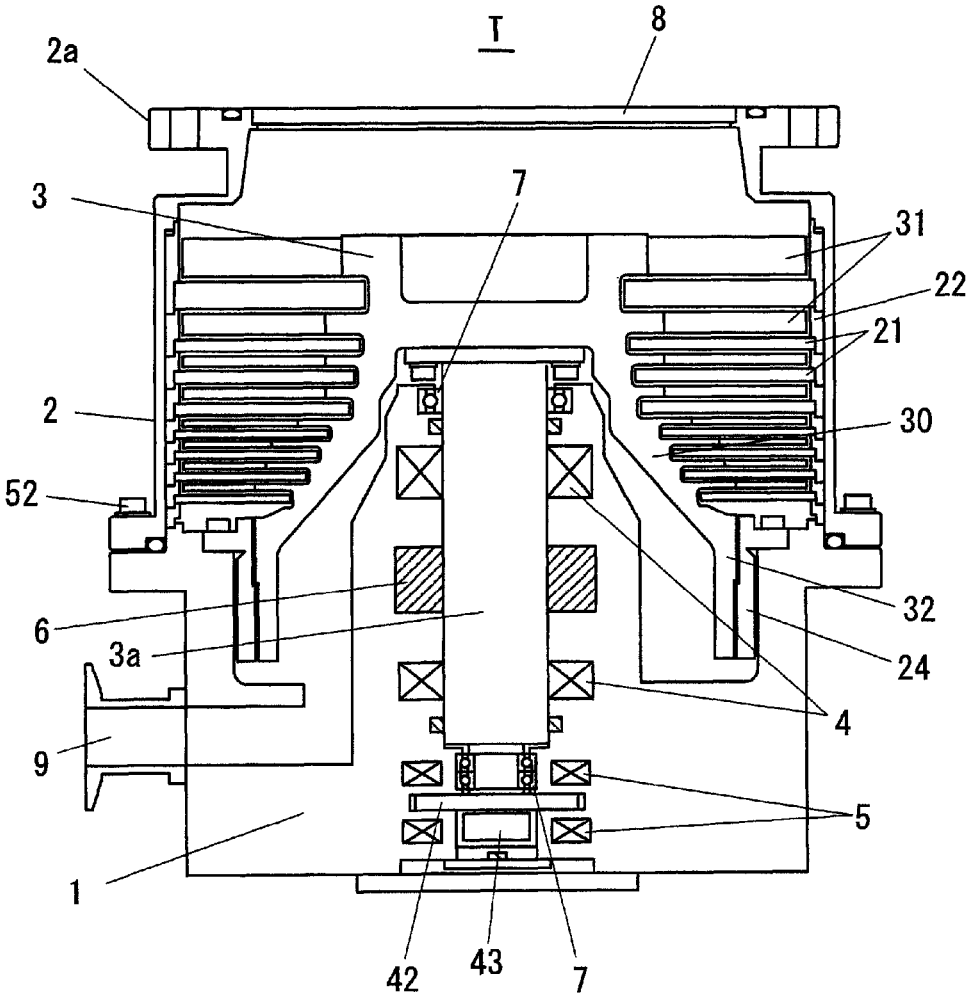

The present invention relates to a vacuum pump equipped with a rotor that rotates at high speed.

BACKGROUND ART

A vacuum pump such as a turbomolecular pump or a molecular drag pump discharges gas in a vacuum chamber by rotating a rotor with a discharge inducing system (a turbine vane unit and a molecular drag pump unit) constituted with turbine vanes and the like formed thereat, at high speed in the order of several tens of thousands of rpm.

If the rotor engaged in such high speed rotation breaks, the pump casing of the vacuum pump will be subjected to extreme high energy. The impact of such energy may be transmitted, via the pump casing, to a vacuum device to which the vacuum pump is connected and may cause damage on the vacuum device side. This concern is addressed in a structure known in the related art that includes a fragile part constituted with a groove, located at a screw groove spacer fixed to a base and assuming a position facing opposite the rotor outer circumference, so as to reduce the shock communicated to the device side by causing a shear fracture at the fragile part (see, for instance, patent literature 1).

Patent literature 1: Japanese Laid Open Patent Publication No. 2006-170217

SUMMARY OF THE INVENTION

Technical Problem

However, there is an issue yet to be effectively addressed in the conventional technology described in the publication cited above in that since a cylindrical portion of the screw groove spacer broken apart at the fragile part is allowed to continue to rotate and move toward the pump gas intake side, the device may become damaged by the cylindrical portion.

Solution to Problem

A vacuum pump according to the present invention comprises a drag pump unit constituted with a cylindrical rotor portion disposed at a rotary body and a cylindrical stator disposed via a gap on an outer circumferential side of the cylindrical rotor portion, wherein: the stator comprises: a cylinder upper portion locked to a pump base; and a cylinder lower portion connected to a discharge downstream side of the cylinder upper portion via a thinned area formed so that a break occurs when the cylindrical rotor portion breaks and a broken cylindrical rotor portion collides with the stator subjecting the stator to a rotational torque working in a direction matching the direction in which the cylindrical rotor portion rotates.

It may be further provided with a turbomolecular pump unit that is disposed further toward the discharge upstream side relative to the drag pump unit, and that comprises rotary vanes formed over a plurality of stages on the discharge upstream side of the rotary body and a plurality of fixed vanes disposed alternately to the plurality of stages of rotary vanes.

The thinned area may be constituted as a groove formed to extend along a circumferential direction at an outer circumferential surface of the cylindrical stator, and the groove may be a V-shaped groove, fully encircling the cylindrical stator at the outer circumferential surface of the cylindrical stator.

Advantageous Effect of the Invention

According to the present invention, the extent to which the vacuum device side is adversely affected in the event of rotor breakdown can be reduced.

BRIEF DESCRIPTION OF THE DRAWINGS (FIG. 1) An illustration of an embodiment of a vacuum pump according to the present invention (FIG. 2) A fixed cylinder 24 achieved in the embodiment, a standard fixed cylinder 34 in the related art and a fixed cylinder 44 disclosed in patent literature 1, shown in semi-sectional views respectively in (a), (b) and (c)

(FIG. 3) Illustrations of the fixed cylinder 24 experiencing a break occurring at a rotational cylinder portion 32 at a rotor 3

(FIG. 4) Illustrations of the fixed cylinder 44 experiencing a break (FIG. 5) Examples of variations of a groove 243

DESCRIPTION OF PREFERRED EMBODIMENTS

The following is a description of an embodiment of the present invention, given in reference to drawings. FIG. 1 is a schematic illustration of the structure adopted in a pump unit T of a magnetic bearing turbomolecular pump achieved as an embodiment of a vacuum pump according to the present invention. It is to be noted that the pump unit T is driven with electric power provided from a power source unit (not shown). This turbomolecular pump may be used to evacuate a chamber formed in, for instance, a semiconductor manufacturing apparatus or the like.

The pump unit T of the turbomolecular pump in FIG. 1 includes a base 1, a casing 2 assuming a substantially cylindrical shape, which is locked to an upper surface of the base 1, and a rotor 3 rotatably disposed inside the casing 2. The base 1 and the casing 2 are fastened together with bolts 52 via an O-ring. A gas intake port flange portion 2*a* disposed at the upper end of the casing 2 is fastened with bolts to a flange at a vacuum chamber located on the semiconductor manufacturing apparatus side (not shown).

The rotor 3, engaged in a high speed rotation, is constituted of an aluminum alloy with high specific strength so as to withstand significant centrifugal force. At the outer circumferential surface of a bell-shaped tubular portion 30 of the rotor 3, rotary vanes 31 are formed over a plurality of stages set apart from one another along the axial direction. In addition, a rotational cylinder portion 32, assuming a substantially cylindrical shape, extends at the bottom of the bell-shaped tubular portion 30. Namely, the rotary vanes 31 and the rotational cylinder portion 32 are disposed respectively on the high vacuum side and on the low vacuum side.

Fixed vanes 21 are each inserted between two successive stages of rotary vanes 31 formed at the rotor 3. These rotary vanes 31 and fixed vanes 21 together constitute a turbine vane unit. The fixed vanes 21 at the various stages are stacked via spacers 22 and the fixed vanes 21 and the spacers 22 together form a stacked assembly. The spacers 22 are substantially ring-shaped members, whereas the fixed vanes 21 are each split into two separate portions along the circumferential direction. The stacked assembly constituted with the fixed vanes 21 and the spacers 22 is held between the upper end surface of the base 1 and an upper end portion of the casing 2 with the fastening force imparted by the bolts 52. The exterior of the stacked assembly is shielded with the casing 2.

In the space surrounding the rotational cylinder portion 32, a fixed cylinder 24 is disposed so as to face opposite the outer circumferential surface of the rotational cylinder portion 32. A spiral groove is formed at the inner circumferential surface of the fixed cylinder 24, and the clearance between the rotational cylinder portion 32 and the fixed cylinder 24 forms a gas passage through which gas travels along the up/down direction. The rotational cylinder portion 32 and the fixed cylinder 24 together constitute a molecular drag pump unit. As the rotor 3 in this turbomolecular pump is engaged in high speed rotation via a motor 6, gas molecules, having flowed in through a gas intake port 8 located at the casing upper end, travel through the gas passages at the turbine vane unit and the molecular drag pump unit, and are discharged through a gas outlet port 9. This gas flow creates a high vacuum state on the side where the gas intake port 8 is located.

The rotor 3 is fastened to a rotating shaft portion 3*a* rotatably supported inside the base 1. The rotating shaft portion 3*a*, supported in a non-contact manner via a pair of radial magnetic bearings 4, i.e., an upper radial magnetic bearing 4 and a lower radial magnetic bearing 4, and a pair of axial magnetic bearings 5, i.e., an upper axial magnetic bearing 5 and a lower axial magnetic bearing 5, is rotationally driven by the motor 6. The axial magnetic bearings 5 are disposed so as to hold a rotor disk 42, disposed under the rotating shaft portion 3*a*, from the top side and the bottom side. The rotor disk 42 is attached to the rotating shaft portion 3*a* via a locking nut 43. The motor 6 may be, for instance, a DC brushless motor. Such a DC brushless motor will include a motor rotor with built-in permanent magnets mounted on the side where the rotating shaft portion 3*a* is present and a motor stator used to form a rotating magnetic field, disposed on the side where the base 1 is present. It is to be noted that a mechanical bearing 7, which supports the rotor 3 when the magnetic bearings 4 and 5 are not engaged in operation, is disposed on the side where the base 1 is present.

The rotor 3 of the turbomolecular pump rotates at a high speed of up to several tens of thousands of rpm. Thus, the rotor 3 is subjected to stress attributable to the centrifugal force and the rotational cylinder portion 32, in particular, is bound to be subjected to very high stress. In addition, the creep temperature at the rotor 3, normally constituted of an aluminum alloy, is relatively low. For this reason, if it is continuously engaged in high speed rotation at high temperature, creep deformation will occur readily. If any failure occurs and the rotor 3 breaks, fragments of the rotational cylinder portion 32 may be caused by centrifugal force to collide with the fixed cylinder 24, thereby subjecting the fixed cylinder 24 to rotational torque manifesting along a direction matching the direction in which the rotor 3 rotates. This rotational torque may be further transmitted to the flange on the device side via the base 1 and the casing 2 and may cause damage on the device side.

In the embodiment, a special structural feature is adopted in the fixed cylinder 24 with which fragments of the broken rotational cylinder portion 32 may collide, so as to reduce the extent of the adverse effect of the rotational torque induced as the rotational cylinder portion 32 breaks as described above on the device side.

Figure 2:
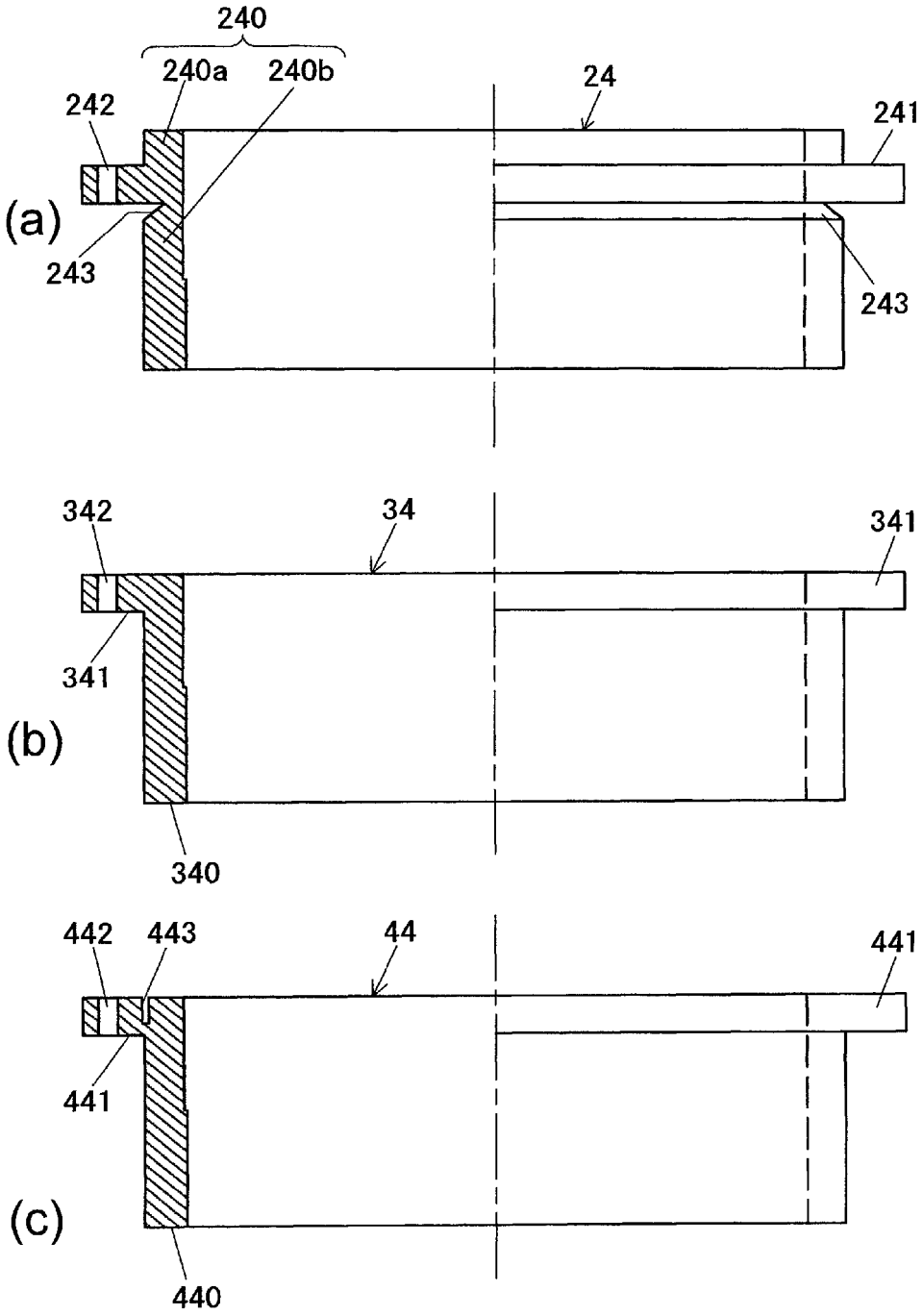

FIG. 2(*a*) is a semi-sectional view of the fixed cylinder 24 of the turbomolecular pump shown in FIG. 1. The fixed cylinder 24 includes a cylinder portion 240 with a screw groove formed at the inner circumferential surface thereof and a flange portion 241 with a plurality of bolt holes 242, via which the fixed cylinder 24 is locked to the base 1, formed therein. A groove 243 is formed at the outer circumferential surface of the cylinder portion 240, i.e., the surface of the cylinder portion 240 facing opposite the base, so as to fully encircle the cylinder portion 240. In other words, the cylinder portion 240 assumes a structure that includes a cylinder upper portion 240*a* and a cylinder lower portion 240*b* linked via the groove 243 forming an area with a smaller thickness.

FIG. 2(*b*) shows a standard stationery cylinder 34 in the related art, constituted with a cylinder portion 340 and a flange portion 341. A plurality of bolt holes 342, via which the fixed cylinder 34 is locked to the base 1 with bolts, are formed at the flange portion 341. A groove 243 such as that shown in FIG. 2(*a*) is not formed at the fixed cylinder 34.

FIG. 2(*c*) shows a fixed cylinder (screw groove spacer) 44 used in the turbomolecular pump disclosed in patent literature 1. At the fixed cylinder 44, a groove 443 is formed between a cylinder portion 440 with a screw groove formed therein and a flange portion 441 with a plurality of bolt holes 442 formed therein. The groove 443 is formed to achieve a ring shape fully encircling the cylinder in the example presented in FIG. 2(*c*).

Figure 3:
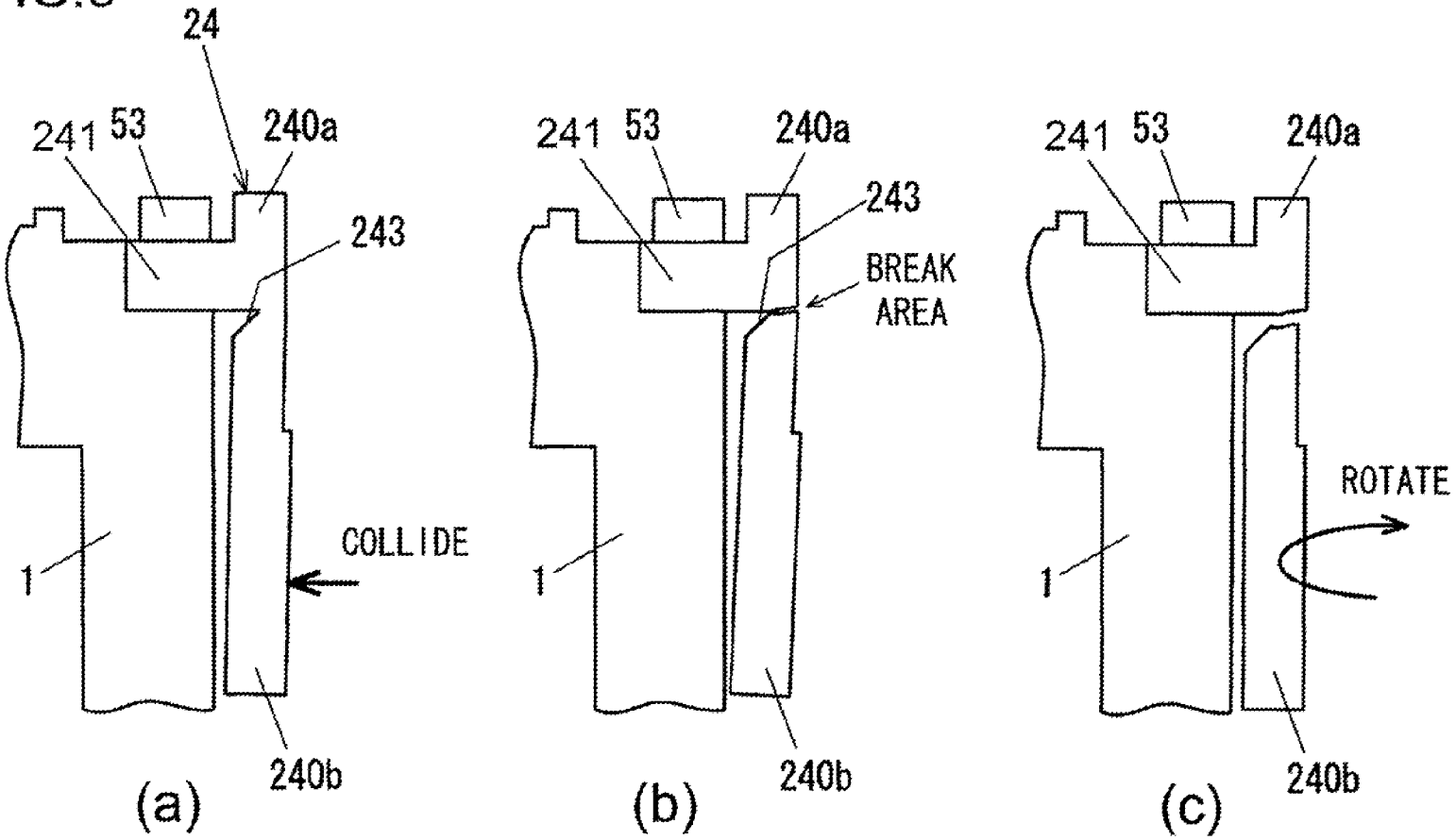

FIG. 3 illustrates the fixed cylinder 24 experiencing a break at the rotational cylinder portion 32 of the rotor 3. In FIG. 3, conditions following the break at the rotational cylinder portion 32 are shown in a time sequence in the order of (a), (b) and (c). The flange portion 241 of the fixed cylinder 24 is locked to the base 1 via bolts 53. While the rotor 3 rotates at high speed, the rotational cylinder portion 32 is subjected to a particularly high level of stress, and in the event of a rotor break, the fracture often starts from the lower end of the rotational cylinder portion 32 and spreads upward. For this reason, the contact location where contact first occurs following a break of the rotational cylinder portion 32 is assumed to be the bottom area of the fixed cylinder 24.

FIG. 3(*a*) shows the broken rotational cylinder portion 32 colliding with the bottom portion of the fixed cylinder 24. In the embodiment, the groove 243 is formed further downward relative to the flange portion 241 and as the rotational cylinder portion 32 collides with the fixed cylinder 24, stress concentration occurs in the area of the groove 243, i.e., the area with smaller thickness. As a result, a deformation, centered on the area where the groove 243 is formed, occurs at the fixed cylinder 24. Since the deformation occurs over the area where the groove 243 is present, the kinetic energy at the rotational cylinder portion 32 is expended.

In the event of a break, kinetic energy of the rotational cylinder portion 32 is very large and the fixed cylinder 24 is subjected to a large rotational torque. Thus, the area of the fixed cylinder 24 where stress concentrates (the area with the smaller wall thickness, where the groove 243 is formed) undergoes a shear fracture. In other words, the strength of the area where the groove 243 is present (the width and the depth of the groove 243) is set so that the area where the groove 243 is present shears off at the time of a rotor break, before the bolts 53 or the flange portion 241 breaks, in the event of a rotor break that causes fragments of a fractured rotational cylinder portion 32 to collide with the fixed cylinder 24 and subjects the fixed cylinder 24 to rotational torque along a direction matching the rotating direction of the rotational cylinder portion 32. The cylinder lower portion 240*b* of the fixed cylinder 24, having broken off, rotates together with the fractured rotational cylinder portion 32 (not shown). Since the cylinder lower portion 240*b* rotates while sustaining contact with the base 1, the rotational energy diminishes as the cylinder lower portion 240*b* continues to rotate, until the gradually decreasing rotation rate equals 0 and the rotation has stopped.

Through these measures, the impact (rotational torque) transmitted to the device side via the base 1 and the casing 2 is reduced.

The fixed cylinder 34 in the related art shown in FIG. 2(*b*), in contrast, does not include any area with a smaller thickness achieved by forming a groove, such as that in the embodiment. The fixed cylinder 34, therefore, does not break readily, and even if it breaks, the break is likely to occur at the fastening bolts. In such a case, an extremely large rotational torque is bound to be communicated to the device side as the rotational cylinder portion 32 breaks.

Figure 4:
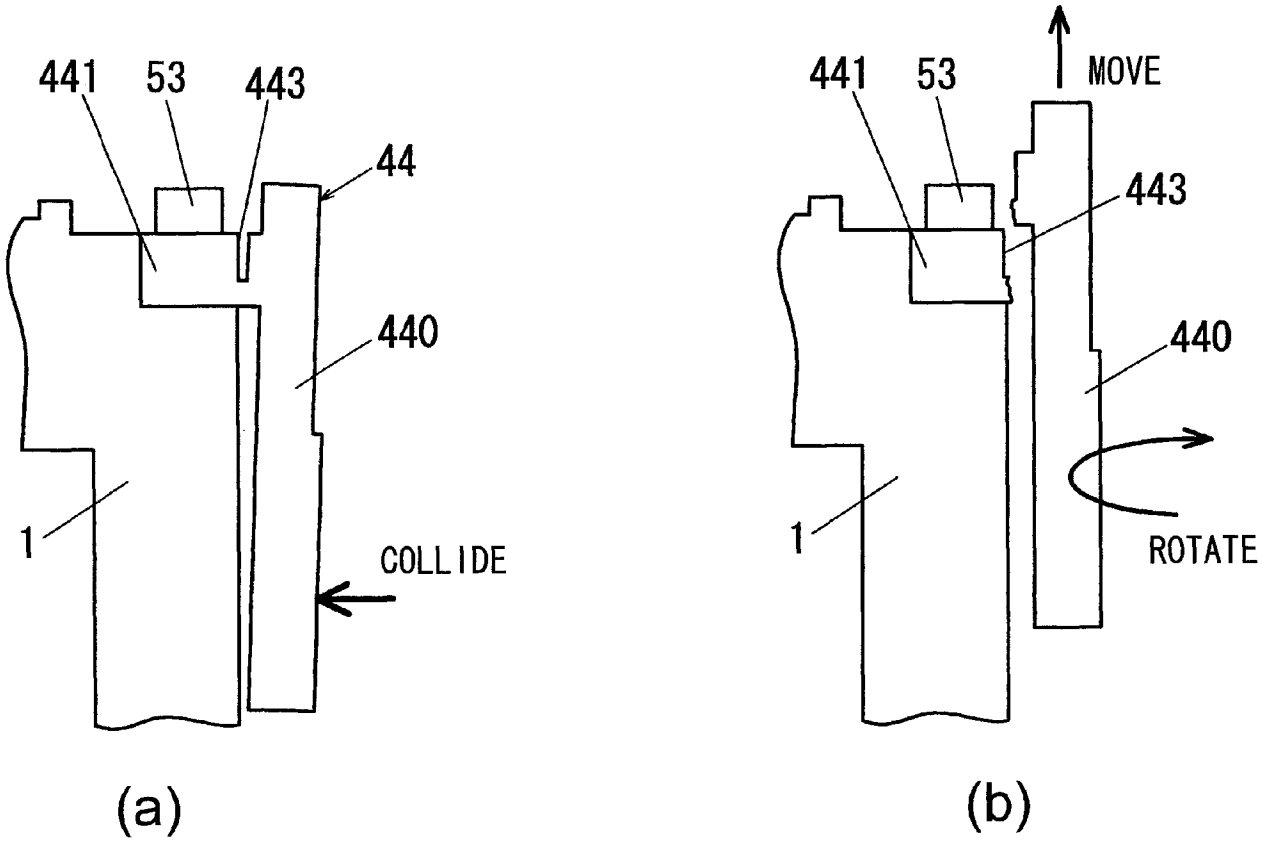

The fixed cylinder 44 in FIG. 2(*c*) includes the groove 443 formed at the base of the flange portion 441 and stress concentration occurs over the area where the groove 443 is present. Thus, the fixed cylinder 44 colliding with the rotational cylinder portion becomes deformed, as shown in FIG. 4(*a*), and ultimately breaks, with the area where the groove 443 is present severed, as illustrated in FIG. 4(*b*). The cylinder portion 440, having broken away from the flange portion 441 rotates while sustaining contact with the base, as does the cylinder lower portion 240*b*, shown in FIG. 3(*c*), and the rotation rate thus gradually decreases.

In the embodiment, even after the cylinder lower portion 240*b* is broken away from the cylinder upper portion 240*a*, the flange portion 241 in the cylinder upper portion 240*a* remain locked to the base 1 and thus, the displacement of the rotating cylinder lower portion 240*b* toward the pump gas intake port is restricted by the cylinder upper portion 240*a*.

In contrast, the cylinder portion 440 of the fixed cylinder 44 in FIG. 2(*c*), having been broken off, may be allowed to move toward the pump gas intake port (upward in the figure) as it rotates, as shown in FIG. 4(*b*). This means that another broken piece pushed upward by the cylinder portion 440 or the cylinder portion 440 itself may be thrown into the device and damage the device. The displacement of the cylinder lower portion 240*b* in the embodiment, on the other hand, is restricted by the cylinder upper portion 240*a*, as explained above, and thus, such an undesirable outcome can be averted.

Figure 5:
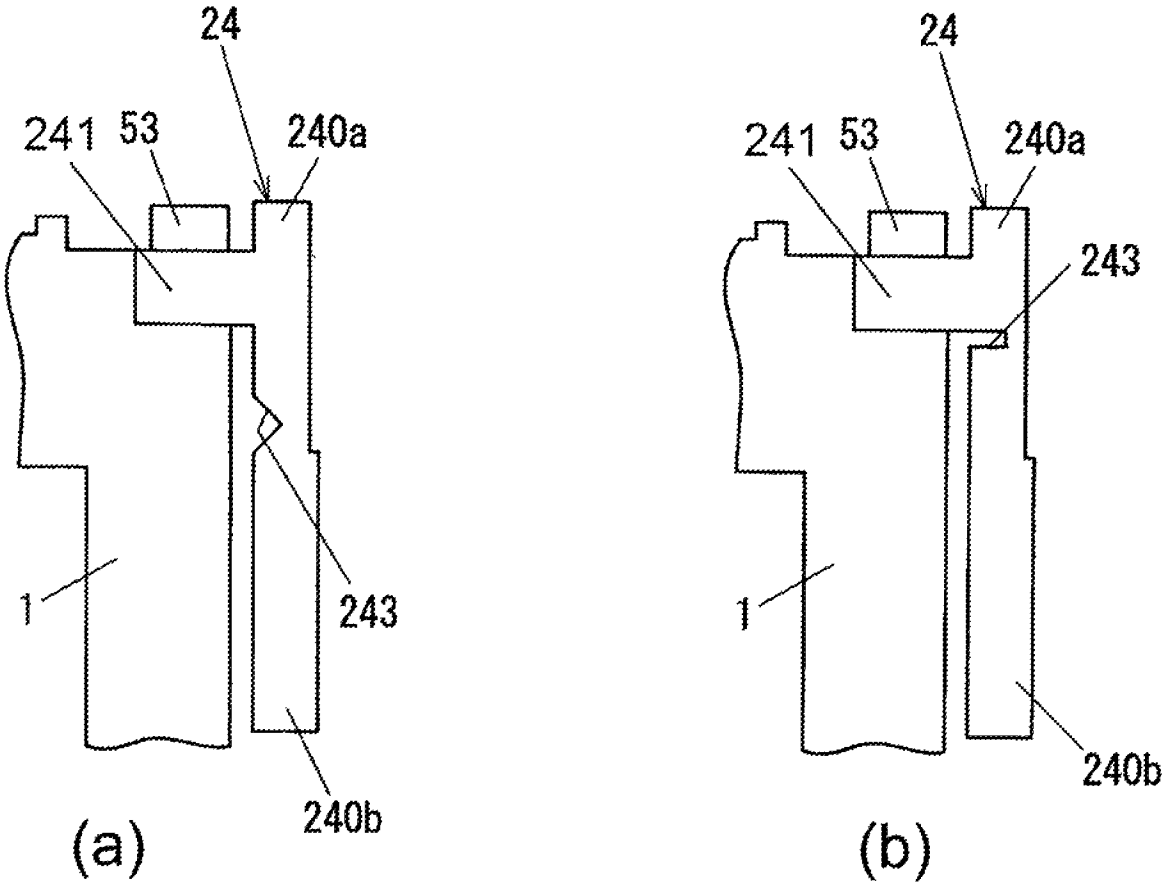

It is to be noted that while the groove 243 is formed adjacent to the area where the flange portion 241 is connected in the example presented in FIG. 2(*a*), a groove with a V-shaped section may instead be formed further downward relative to the flange portion 241 (toward the discharge downstream side) at a position such as that shown in FIG. 5(*a*). In addition, the groove 243 does not need to have a V-shaped section and instead, the groove 243 may be formed as a slit, as shown in FIG. 5(*b*). Furthermore, as long as the level of the strength over the area where the groove 243 is formed is set so that the area is twisted and broken off by the rotational torque imparted in the event of a rotor break, the groove 243 does not need to fully encircle the fixed cylinder 24. In other words, a plurality of grooves may be formed over intervals.

It is to be noted that since the groove 243 in the embodiment is formed at the outer circumferential surface of the fixed cylinder 24 instead of the inner circumferential surface (gas discharge surface) of the fixed cylinder 24, the presence of the groove 243 at the fixed cylinder 24 does not adversely effect the pump gas discharge performance.

The embodiments described above may be adopted singularly or in combination to realize a singular advantage or combination of advantages. In addition, as long as the features characterizing the present invention are not compromised, the present invention is not limited to any of the specific structural particulars described herein. For instance, while the present invention is adopted in a turbomolecular pump with a turbine vane unit (rotary vanes 31) and a drag pump unit (the outer circumferential surface of the rotational cylinder portion 32) formed at the outer circumferential surface of the cylindrical rotor 3 in the embodiments described above, the present invention is not limited to this example and may be adopted in a vacuum pump equipped with a drag pump unit (the rotational cylinder portion 32 and the fixed cylinder 24) alone.

The invention claimed is:

1. A vacuum pump comprising a drag pump unit constituted with a cylindrical rotor portion disposed at a rotary body and a cylindrical stator disposed via a gap on an outer circumferential side of the cylindrical rotor portion, wherein:

the stator comprises:

a cylinder upper portion locked to a pump base; and a cylinder lower portion connected to a discharge downstream side of the cylinder upper portion via a thinned area formed so that a break occurs when the cylindrical rotor portion breaks and a broken cylindrical rotor portion collides with the stator subjecting the stator to a rotational torque working in a direction matching the direction in which the cylindrical rotor portion rotates.

2. A vacuum pump, according to claim 1, further comprising:

a turbine vane unit that is disposed further toward the discharge upstream side relative to the drag pump unit, and that comprises rotary vanes formed over a plurality of stages on the discharge upstream side of the rotary body and a plurality of fixed vanes disposed alternately to the plurality of stages of rotary vanes.

3. A vacuum pump according to claim 2, wherein:

the thinned area is constituted as a groove formed to extend along a circumferential direction at an outer circumferential surface of the cylindrical stator.

4. A vacuum pump according to claim 1, wherein:

the thinned area is constituted as a groove formed to extend along a circumferential direction at an outer circumferential surface of the cylindrical stator.

5. A vacuum pump according to claim 4, wherein:

the groove is a V-shaped groove, fully encircling the cylindrical stator at the outer circumferential surface of the cylindrical stator.

* * * * *